US011406889B1

(12) United States Patent
Mounier

(10) Patent No.: US 11,406,889 B1
(45) Date of Patent: Aug. 9, 2022

(54) CUPHOLDER FOR SNOWBOARD

(71) Applicant: Jason Mounier, Tappen, NY (US)

(72) Inventor: Jason Mounier, Tappen, NY (US)

( * ) Notice: Subject to any disclaimer, the term of this patent is extended or adjusted under 35 U.S.C. 154(b) by 150 days.

(21) Appl. No.: 16/922,032

(22) Filed: Jul. 7, 2020

(51) Int. Cl.
*A63C 10/28* (2012.01)
*A47G 23/02* (2006.01)
*A63C 11/26* (2006.01)

(52) U.S. Cl.
CPC ..... *A63C 10/28* (2013.01); *A47G 23/0216* (2013.01); *A63C 11/26* (2013.01)

(58) Field of Classification Search
CPC ..... A63C 10/28; A63C 10/10; A63C 11/26; A63C 11/00; A63C 11/007; A47G 23/0216
USPC ..... 248/309.1
See application file for complete search history.

(56) References Cited

U.S. PATENT DOCUMENTS 6,089,581 A * 7/2000 Partridge ..... A63C 10/20 441/74
6,145,715 A 11/2000 Slonim
6,217,041 B1 * 4/2001 Hauser ..... A63C 5/03 280/14.22
6,375,134 B1 * 4/2002 Goldschmidt ..... A47G 19/08 248/154
6,457,746 B1 * 10/2002 Schepers ..... A63C 11/00 280/809
6,571,976 B1 6/2003 Sonnabend
7,484,765 B2 * 2/2009 Harper ..... A63C 11/10 280/809
8,485,556 B2 7/2013 Shaheen
8,528,930 B2 * 9/2013 Titterington ..... G03B 17/561 280/623
9,803,681 B2 10/2017 Esposito
10,329,710 B2 6/2019 Barnwell
10,874,933 B2 * 12/2020 Thompson ..... B62B 17/063
2004/0055927 A1 3/2004 McNutt
2008/0011925 A1 1/2008 Ruff
2009/0026731 A1 * 1/2009 Stewart, III ..... A63C 5/06 280/611
2011/0114656 A1 5/2011 Tupy
2015/0059637 A1 3/2015 Johns
2016/0242564 A1 * 8/2016 Cass ..... A47C 21/00
2016/0324350 A1 * 11/2016 Rogers ..... A47G 23/0216
2018/0199742 A1 * 7/2018 Rogers ..... A47G 23/0216

FOREIGN PATENT DOCUMENTS

WO 2011060039 5/2011

* cited by examiner

*Primary Examiner* — Nkeisha Smith
(74) *Attorney, Agent, or Firm* — Kyle A. Fletcher, Esq.

(57) ABSTRACT

The cupholder for snowboard is configured for use with a snowboard. The snowboard further comprises a binding. The cupholder for snowboard is a containment structure. The cupholder for snowboard attaches to the binding of the snowboard. The cupholder for snowboard is configured for use with a beverage. The cupholder for snowboard stores the beverage during the use of the snowboard. The cupholder for snowboard comprises the snowboard and containment apparatus. The containment apparatus attaches to the binding of the snowboard. The containment apparatus stores the beverage.

19 Claims, 5 Drawing Sheets

CUPHOLDER FOR SNOWBOARD

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of transportation and conveying including storage containers for transport, more specifically, a container for a specific transportation problem.

SUMMARY OF INVENTION

The cupholder for snowboard is configured for use with a snowboard. The snowboard further comprises a binding. The cupholder for snowboard is a containment structure. The cupholder for snowboard attaches to the binding of the snowboard. The cupholder for snowboard is configured for use with a beverage. The cupholder for snowboard stores the beverage during the use of the snowboard. The cupholder for snowboard comprises the snowboard and containment apparatus. The containment apparatus attaches to the binding of the snowboard. The containment apparatus stores the beverage.

These together with additional objects, features and advantages of the cupholder for snowboard will be readily apparent to those of ordinary skill in the art upon reading the following detailed description of the presently preferred, but nonetheless illustrative, embodiments when taken in conjunction with the accompanying drawings.

In this respect, before explaining the current embodiments of the cupholder for snowboard in detail, it is to be understood that the cupholder for snowboard is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the cupholder for snowboard.

It is therefore important that the claims be regarded as including such equivalent construction insofar as they do not depart from the spirit and scope of the cupholder for snowboard. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
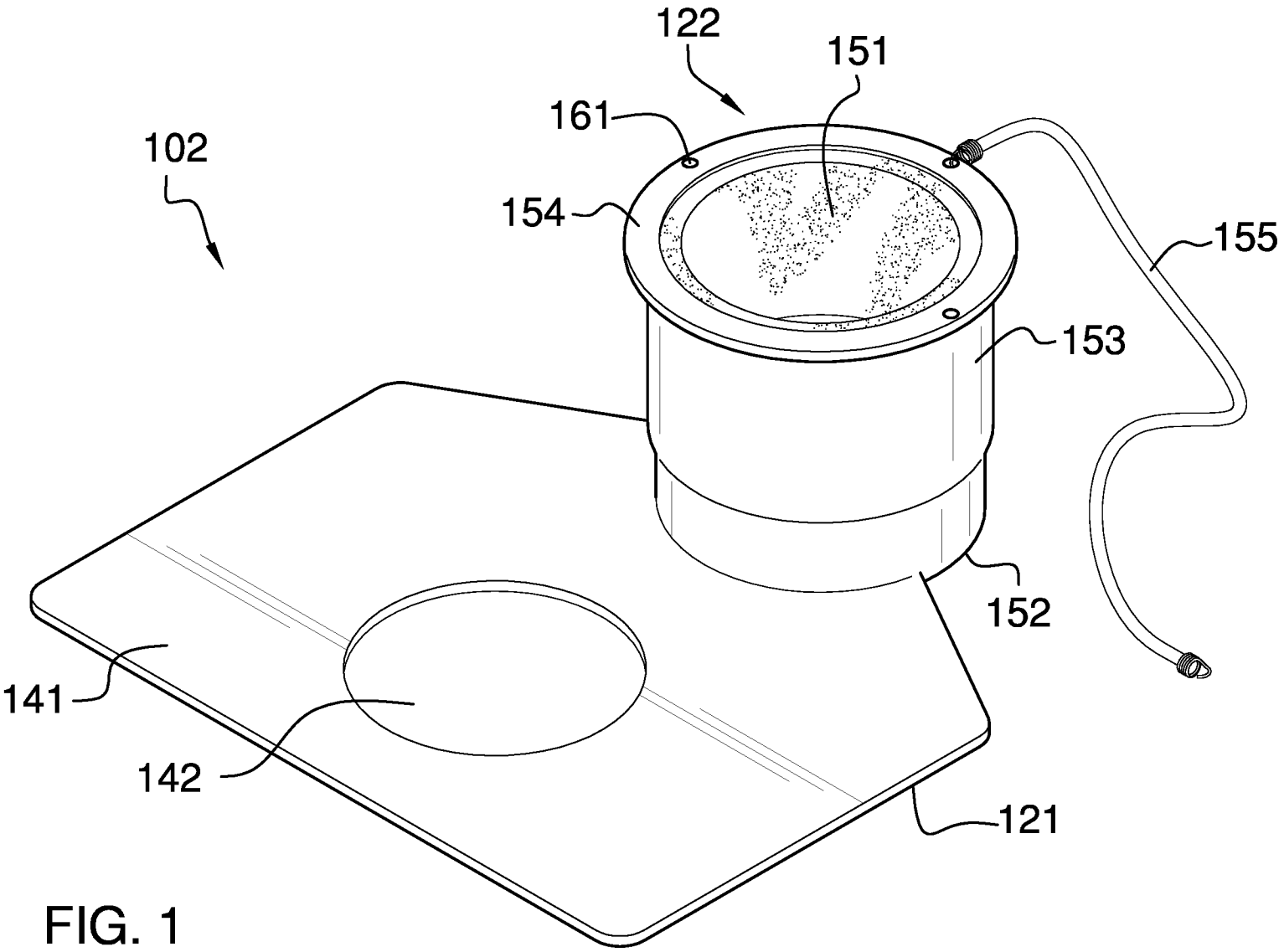
FIG. 1 is a perspective view of an embodiment of the disclosure.
Figure 2:
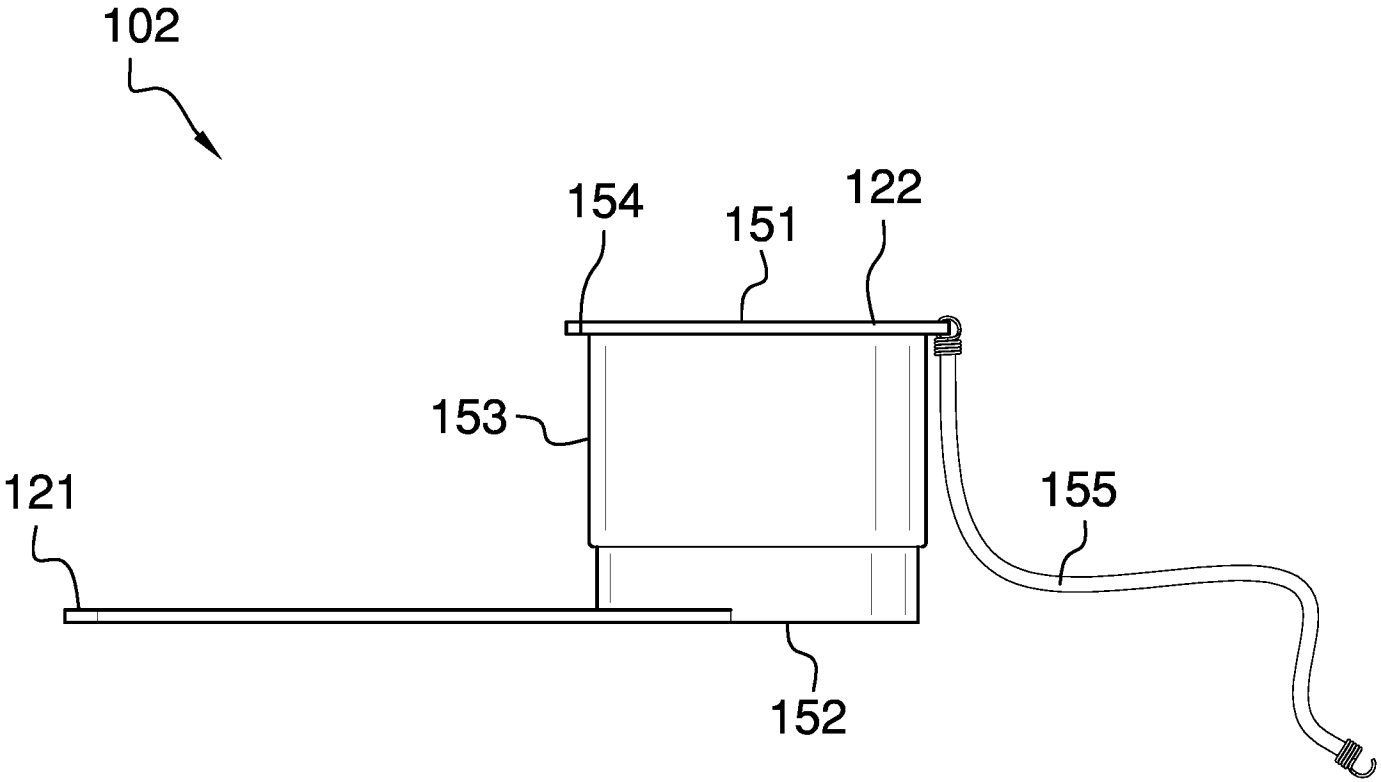
FIG. 2 is a side view of an embodiment of the disclosure.
Figure 3:
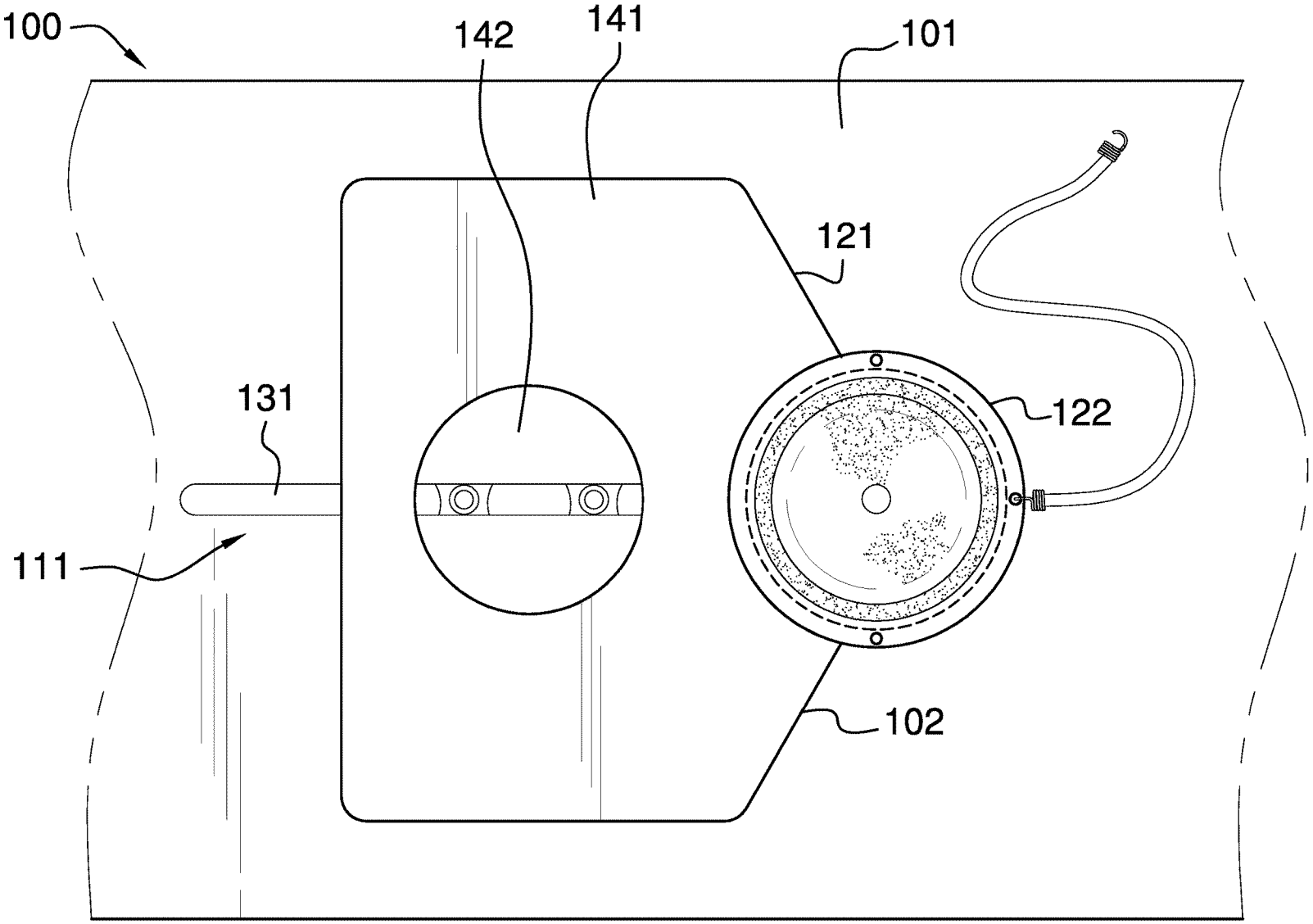
FIG. 3 is a top view of an embodiment of the disclosure.
Figure 4:
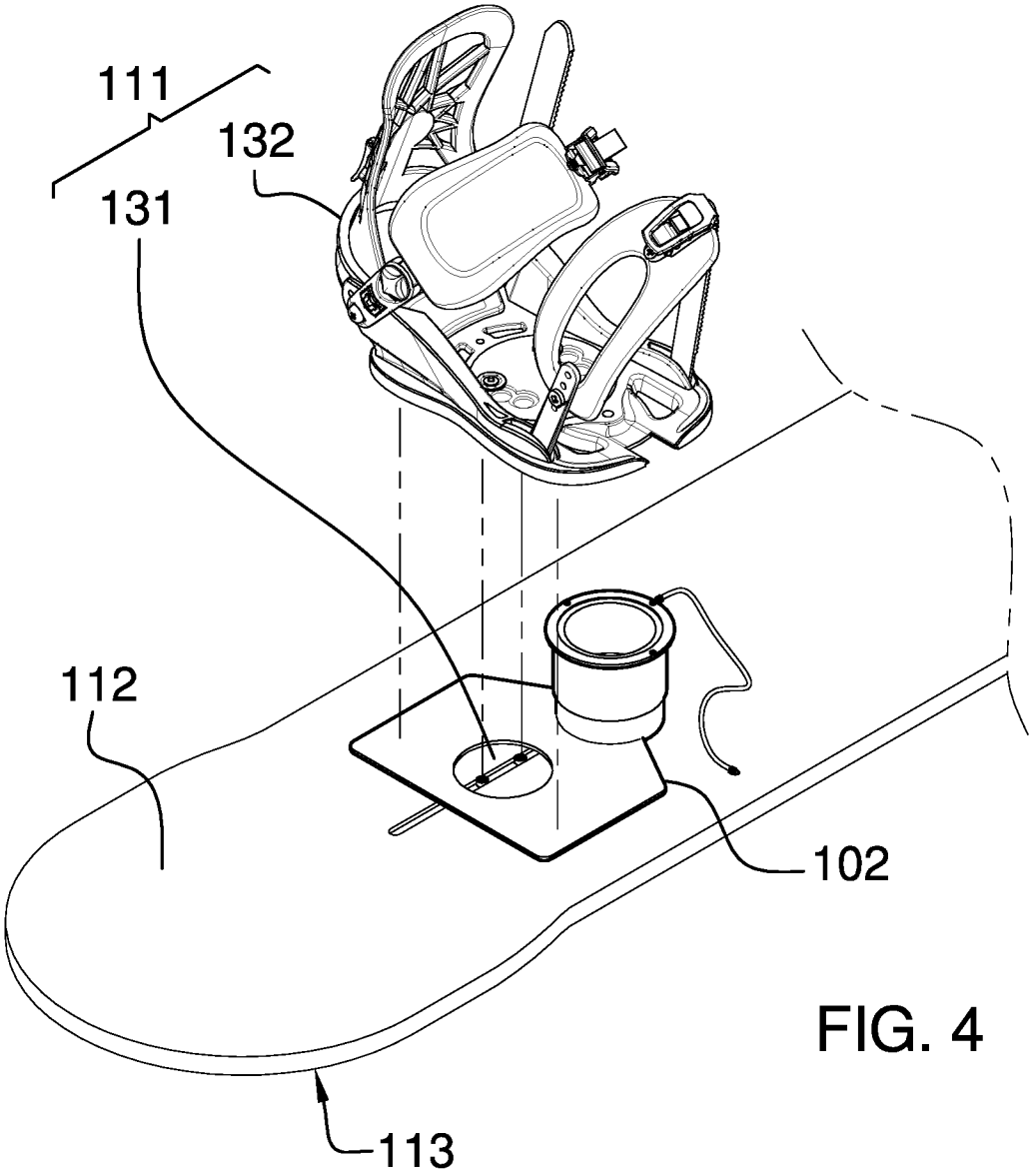
FIG. 4 is an exploded view of an embodiment of the disclosure.
Figure 5:
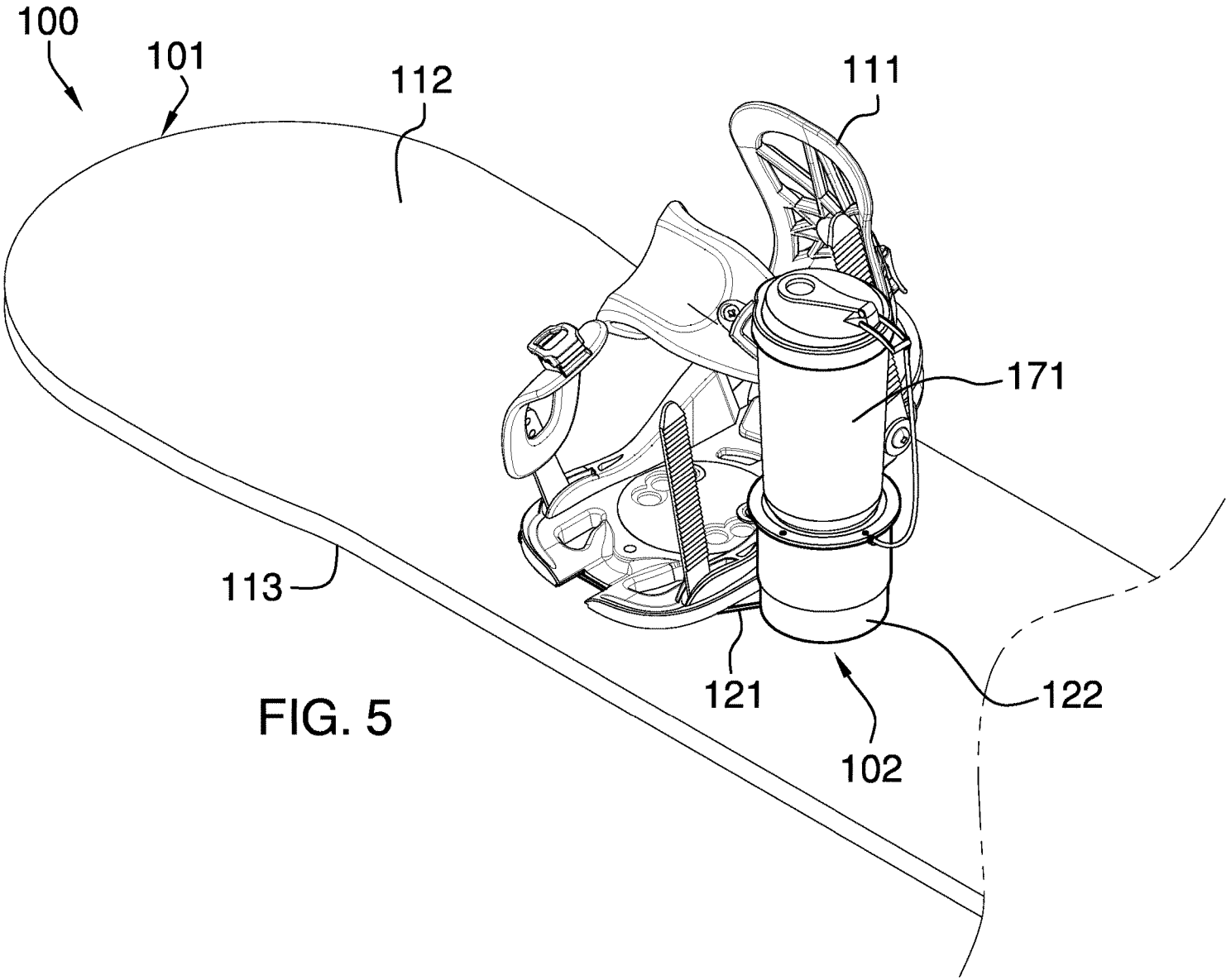
FIG. 5 is an in-use view of an embodiment of the disclosure.

Detailed reference will now be made to one or more potential embodiments of the disclosure, which are illustrated in FIGS. 1 through 5.

The cupholder for snowboard 100 (hereinafter invention) is configured for use with a snowboard 101. The snowboard 101 further comprises a master binding 111. The invention 100 is a containment structure. The invention 100 attaches to the master binding 111 of the snowboard 101. The invention 100 is configured for use with a beverage 171. The invention 100 stores the beverage 171 during the use of the snowboard 101. The invention 100 comprises the snowboard 101 and containment apparatus 102. The containment apparatus 102 attaches to the master binding 111 of the snowboard 101. The containment apparatus 102 stores the beverage 171. In this disclosure, the beverage 171 is assumed to include the storage container that contains the beverage 171.

The snowboard 101 is a mechanical structure. The snowboard 101 is a layered composite structure. The snowboard 101 is a non-Euclidean disk structure. The snowboard 101 is a device used for a physical activity known as snowboarding. The snowboard 101 comprises a master binding 111, a superior surface 112, and an inferior surface 113.

The master binding 111 is a fastening structure. The master binding 111 attaches a boot to the snowboard 101. The boot is worn by the individual who is snowboarding. The master binding 111 comprises a mounting hardware 131 and a boot binding 132.

The mounting hardware 131 is a mechanical structure. The mounting hardware 131 rigidly attaches to the superior surface 112 of the snowboard 101. The mounting hardware 131 forms a pedestal structure that transfers the load borne by the boot binding 132 to the snowboard 101.

The boot binding 132 is a mechanical structure. The boot binding 132 forms a harness. The boot binding 132 rigidly attaches to the mounting hardware 131 such that the boot binding 132 maintains a fixed position relative to the snowboard 101.

The superior surface 112 is a congruent end of the non-Euclidean disk structure that forms the snowboard 101. The superior surface 112 forms the concave surface of the non-Euclidean disk structure of the snowboard 101. The master binding 111 attaches to the superior surface 112 of the snowboard 101.

The inferior surface 113 is a congruent end of the non-Euclidean disk structure that forms the snowboard 101. The inferior surface 113 forms the convex surface of the non-Euclidean disk structure of the snowboard 101. The inferior surface 113 is the surface of the snowboard 101 that is placed on the snow during snowboarding activities. The inferior surface 113 is the surface of the snowboard 101 that is distal from the superior surface 112.

The containment apparatus 102 is a mechanical structure. The containment apparatus 102 attaches to the superior surface 112 of the snowboard 101. The containment apparatus 102 is configured for use with a beverage 171. The containment apparatus 102 secures the beverage 171 to the snowboard 101 during snowboarding activities. The containment apparatus 102 attaches to the master binding 111 of the snowboard 101. Specifically, a disk-shaped element of the containment apparatus 102 forms a layer of the master binding 111 that is sandwiched between the mounting hardware 131 and the boot binding 132 of the master binding 111. The containment apparatus 102 comprises a mounting plate 121, a beverage 171 pan 122, and one or more bungee cords 155.

The mounting plate 121 attaches to the beverage 171 pan 122. The mounting plate 121 secures the beverage 171 pan 122 to the master binding 111. The mounting plate 121 is a rigid structure. The mounting plate 121 is a disk-shaped structure. The mounting plate 121 is formed as a ring. The disk structure of the mounting plate 121 inserts between the mounting hardware 131 and the boot binding 132 such that the mounting plate 121 is secured to the master binding 111 as the boot binding 132 inserts through the binding aperture 142 of the mounting plate 121 to attach to the mounting hardware 131. The mounting plate 121 comprises a five-side disk 141 and a binding aperture 142.

The five-side disk 141 is a rigid structure. The five-side disk 141 is a disk-shaped structure. The five-side disk 141 is formed as a polygon with five sides. The polygon can be a regular or irregular polygon. The five-side disk 141 physically attaches to the beverage 171 pan 122. The five-side disk 141 physically attaches the beverage 171 pan 122 to the master binding 111. The five-side disk 141 forms the plate structure that inserts between the boot binding 132 and the mounting hardware 131.

The binding aperture 142 is a negative space that is formed through the congruent ends of the disk structure of the five-side disk 141. The binding aperture 142 forms the aperture through the five-side disk 141 that is characteristic of a ring structure. The structure of the boot binding 132 that attaches to the mounting hardware 131 inserts through the binding aperture 142 to attach to the mounting hardware 131.

The beverage 171 pan 122 is hollow prism-shaped structure. The beverage 171 pan 122 is formed as a pan. The beverage 171 pan 122 is geometrically similar to the beverage 171 such that the beverage 171 inserts into the beverage 171 pan 122. The beverage 171 pan 122 forms a mechanical structure that secures the beverage 171 to the containment apparatus 102 during snowboarding activities. The beverage 171 pan 122 comprises an open end 151, a closed end 152, a lateral face 153, and a rim 154.

The open end 151 forms a congruent end of the prism structure that forms the beverage 171 pan 122. The open end 151 is the open end 151 of the pan structure that is formed by the beverage 171 pan 122. The open end 151 is the aperture that receives the beverage 171 into the beverage 171 pan 122 for storage. The position of the open end 151 is distal from the superior surface 112 of the snowboard 101.

The closed end 152 forms a congruent end of the prism structure that forms the beverage 171 pan 122. The closed end 152 is the closed end 152 of the pan structure that is formed by the beverage 171 pan 122. The closed end 152 is distal from the open end 151. The position of the closed end 152 is proximal to the superior surface 112 of the snowboard 101.

The lateral face 153 of the prism structure of the beverage 171 pan 122 forms the physical barriers that contain the beverage 171 in the beverage 171 pan 122.

The rim 154 is an undercut ledge that projects away from the lateral face 153 of the prism structure of the beverage 171 pan 122. The position of the rim 154 is flush with the open end 151 of the prism structure of the beverage 171 pan 122. The rim 154 comprises a plurality of anchor points 161. The plurality of anchor points 161 forms a plurality of apertures through the rim 154. Each of the plurality of anchor points 161 forms an anchor point to which a bungee cord selected from the one or more bungee cords 155 attaches.

Each of the one or more bungee cords 155 is an elastic cord. Each of the one or more bungee cords 155 binds the beverage 171 into the beverage 171 pan 122. The one or more bungee cords 155 secure to the beverage 171 to the plurality of anchor points 161.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Binding: As used in this disclosure, a binding is a fastening structure that removably attaches a first object to a surface.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned.

When the center axes of two cylinder, prism or pyramidal structures do not share the same line they are said to be offset.

Composite: As used in this disclosure, composite refers to a two-dimensional or three-dimensional structure that that is formed from two or more distinctly identifiable layered sub-structures.

Concave: As used in this disclosure, concave is used to describe: 1) a surface that resembles the interior surface of a sphere; or, 2) a function with a curvature structure wherein a chord that connects any two points of the function will be lesser than (graphically below) or equal to the value of the function at any point along the chord.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Convex: As used in this disclosure, convex is used to describe: 1) a surface that resembles the outer surface of a sphere; or, 2) a function with a curvature structure wherein a chord that connects any two points of the function will be greater than (graphically above) or equal to the value of the function at any point along the chord.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Cord: As used in this disclosure, an elastic cord is a cord that contains elastic yarns as some of the yarns that make up the cord. An elastic cord is constructed such that the elastic cord will stretch when a force is applied and will return to its original shape when after the force is removed. Shock cord and bungee cord are synonyms for elastic cord.

Flush: As used in this disclosure, the term flush is used to describe the alignment of a first surface and a second surface to form a single structure selected from the group consisting of a Euclidean plane and a non-Euclidean plane.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Harness: As used in this disclosure, a harness is an apparatus comprising a plurality of straps and one or more fasteners that is used to fasten or anchor a first person or first object to a second object. The phrase N point harness refers to the installation of the harness wherein the harness has N anchor points. For example, a 2 point harness has two anchor points while a 5 point harness has 5 anchor points.

Ledge: As used in this disclosure, a ledge is a horizontal surface that projects away from a vertical structure. A ledge that projects away from, or overhangs, the vertical structure in the manner of a cantilever is referred to as an undercut ledge.

Negative Space: As used in this disclosure, negative space is a method of defining an object through the use of open or empty space as the definition of the object itself, or, through the use of open or empty space to describe the boundaries of an object.

Non-Euclidean Disk: As used in this disclosure, a non-Euclidean structure is a disk-shaped structure wherein the congruent end (faces) of the disk structure lies on a non-Euclidean plane.

Non-Euclidean Structure: As used in this disclosure, a non-Euclidean structure is a structure wherein an axis of the structure lies on a non-Euclidean plane or is otherwise formed with a curvature.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of the prism structure of the pan and/or a portion of the closed lateral faces of the pan are open.

Pedestal: As used in this disclosure, a pedestal is an intermediary load bearing structure that that forms a load path between two objects or structures.

Perimeter: As used in this disclosure, a perimeter is one or more curved or straight lines that bounds an enclosed area on a plane or surface. The perimeter of a circle is commonly referred to as a circumference.

Polygon: As used in this disclosure, a polygon refers to a closed planar figure comprising three or more sides. Any two adjacent sides selected from the three or more sides attach to each other such that the two adjacent sides form an interior arc with a cant of less than 180 degrees. A regular polygon is defined as a polygon wherein: a) the span of the length of any side selected from the three or more sides equals the span of the length of any unselected side remaining in the three or more sides; and, b) the arc of the cant between any two adjacent sides selected from the three or more sides equals the arc of the cant of any two unselected sides remaining in the three or more sides. Polygons are often referred to as N-gons where N refers to the number of sides. For example, a pentagon has five sides and a hexagon has six sides.

Plate: As used in this disclosure, a plate is a smooth, flat and semi-rigid or rigid structure that has at least one dimension that: a) is of uniform thickness; and b) that appears thin relative to the other dimensions of the object. Plates often have a rectangular appearance. Plates often have a disk-like structure. The face of the plate is a surface of the plate selected from the group consisting of: a) the surface of the plate with the greatest surface area; b) the surface of the plate that is distal from the surface of the plate with the greatest surface area. The edges of the plate comprises the surfaces of the plate that would not be considered faces as defined above. As defined in this disclosure, plates may be made of any material, but are commonly made of metal, plastic, and wood. When made of wood, a plate is often referred to as a board or a plank.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Relaxed Shape: As used in this disclosure, a structure is considered to be in its relaxed state when no shear, strain, or torsional forces are being applied to the structure.

Rigid Structure: As used in this disclosure, a rigid structure is a solid structure formed from an inelastic material that resists changes in shape. A rigid structure will permanently deform as it fails under a force.

Rim: As used in this disclosure, a rim is an outer edge or border that follows along the perimeter of an object.

Ring: As used in this disclosure, a ring is term that is used to describe a disk-like structure through which a negative space is formed. Rings are often considered loops.

Roughly: As used in this disclosure, roughly refers to a comparison between two objects. Roughly means that the difference between one or more parameters of the two compared objects are not significantly different.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A cupholder for snowboard comprising
a snowboard and containment apparatus;
wherein the containment apparatus attaches to a master binding of the snowboard;
wherein the cupholder for snowboard attaches to the master binding;
wherein the cupholder for snowboard is a containment structure;
wherein the cupholder for snowboard is configured for use with a beverage;
wherein the cupholder for snowboard stores the beverage during the use of the snowboard;
wherein the containment apparatus stores the beverage;
wherein the containment apparatus comprises a mounting plate, a beverage pan, and one or more bungee cords;
wherein the mounting plate attaches to the beverage pan;
wherein the one or more bungee cords secure the beverage in the beverage pan.

2. The cupholder for snowboard according to claim 1
wherein the snowboard is a mechanical structure;
wherein the snowboard is a layered composite structure;
wherein the snowboard is a non-Euclidean disk structure.

3. The cupholder for snowboard according to claim 2
wherein the containment apparatus is a mechanical structure;
wherein the containment apparatus is configured for use with a beverage;
wherein the containment apparatus secures the beverage to the snowboard.

4. The cupholder for snowboard according to claim 3
wherein the snowboard comprises the master binding, a superior surface, and an inferior surface;
wherein the master binding is a fastening structure;
wherein the master binding attaches a boot to the snowboard;
wherein the superior surface is a congruent end of the non-Euclidean disk structure that forms the snowboard;
wherein the superior surface forms the concave surface of the non-Euclidean disk structure of the snowboard;
wherein the master binding attaches to the superior surface of the snowboard;
wherein the inferior surface is a congruent end of the non-Euclidean disk structure that forms the snowboard;
wherein the inferior surface forms the convex surface of the non-Euclidean disk structure of the snowboard;
wherein the inferior surface is the surface of the snowboard that is placed on the snow during snowboarding activities;
wherein the inferior surface is the surface of the snowboard that is distal from the superior surface.

5. The cupholder for snowboard according to claim 4
wherein the containment apparatus attaches to the master binding of the snowboard;
wherein the containment apparatus attaches to the superior surface of the snowboard.

6. The cupholder for snowboard according to claim 5
wherein the master binding comprises a mounting hardware and a boot binding;

wherein a disk-shaped element of the containment apparatus forms a layer of the master binding that is sandwiched between the mounting hardware and the boot binding of the master binding.

7. The cupholder for snowboard according to claim 6
wherein the mounting hardware forms a pedestal structure that transfers a load borne by the boot binding to the snowboard.

8. The cupholder for snowboard according to claim 7
wherein the mounting hardware is a mechanical structure;
wherein the mounting hardware rigidly attaches to the superior surface of the snowboard.

9. The cupholder for snowboard according to claim 8
wherein the boot binding is a mechanical structure;
wherein the boot binding forms a harness;
wherein the boot binding rigidly attaches to the mounting hardware such that the boot binding maintains a fixed position relative to the snowboard.

10. The cupholder for snowboard according to claim 9
wherein the mounting plate secures the beverage pan to the master binding;
wherein the mounting plate is a rigid structure;
wherein the mounting plate is a disk-shaped structure;
wherein the mounting plate is formed as a ring.

11. The cupholder for snowboard according to claim 10
wherein the disk structure of the mounting plate inserts between the mounting hardware and the boot binding such that the mounting plate is secured to the master binding as the boot binding inserts through a binding aperture of the mounting plate to attach to the mounting hardware.

12. The cupholder for snowboard according to claim 11
wherein the beverage pan is a hollow prism-shaped structure;
wherein the beverage pan is formed as a pan;
wherein the beverage pan is geometrically similar to the beverage such that the beverage inserts into the beverage pan;
wherein the beverage pan forms a mechanical structure that secures the beverage to the containment apparatus during snowboarding activities.

13. The cupholder for snowboard according to claim 12
wherein the mounting plate comprises a five-side disk and the binding aperture;
wherein the binding aperture is a negative space that is formed through the five-side disk.

14. The cupholder for snowboard according to claim 13
wherein the five-side disk is a rigid structure;
wherein the five-side disk is a disk-shaped structure;
wherein the five-side disk is formed as a polygon with five sides.

15. The cupholder for snowboard according to claim 14
wherein the five-side disk physically attaches to the beverage pan;
wherein the five-side disk physically attaches the beverage pan to the master binding;
wherein the five-side disk forms a plate structure that inserts between the boot binding and the mounting hardware.

16. The cupholder for snowboard according to claim 15
wherein the binding aperture is a negative space that is formed through congruent ends of the disk structure of the five-side disk;
wherein the binding aperture forms the aperture through the five-side disk that is characteristic of a ring structure;
wherein a structure of the boot binding that attaches to the mounting hardware inserts through the binding aperture to attach to the mounting hardware.

17. The cupholder for snowboard according to claim 16
wherein the beverage pan comprises an open end, a closed end, a lateral face, and a rim;
wherein the open end forms a congruent end of the prism structure that forms the beverage pan;
wherein the open end is the open end of the pan structure that is formed by the beverage pan;
wherein the open end is an aperture that receives the beverage into the beverage pan for storage;
wherein a position of the open end is distal from the superior surface of the snowboard;
wherein the closed end forms a congruent end of the prism structure that forms the beverage pan;
wherein the closed end is the closed end of the pan structure that is formed by the beverage pan;
wherein the closed end is distal from the open end;
wherein the position of the closed end is proximal to the superior surface of the snowboard;
wherein a lateral face of the prism structure of the beverage pan forms a physical barrier that contain the beverage in the beverage pan.

18. The cupholder for snowboard according to claim 17
wherein the rim is an undercut ledge that projects away from the lateral face of the prism structure of the beverage pan;
wherein the position of the rim is flush with the open end of the prism structure of the beverage pan;
wherein the rim comprises a plurality of anchor points;
wherein the plurality of anchor points forms a plurality of apertures through the rim;
wherein each of the plurality of anchor points forms an anchor point to which a bungee cord selected from the one or more bungee cords attaches.

19. The cupholder for snowboard according to claim 18
wherein each of the one or more bungee cords is an elastic cord;
wherein each of the one or more bungee cords binds the beverage into the beverage pan;
wherein the one or more bungee cords secure to the beverage to the plurality of anchor points.

* * * * *